US010753604B2

(12) United States Patent
Von Raven et al.

(10) Patent No.: US 10,753,604 B2
(45) Date of Patent: Aug. 25, 2020

(54) METHOD FOR THE COMBUSTION MANAGEMENT IN FIRING INSTALLATIONS AND FIRING INSTALLATION

(71) Applicant: Martin GmbH fuer Umwelt- und Energietechnik, Munich (DE)

(72) Inventors: Robert Von Raven, Seeshaupt (DE); Johannes Martin, Munich (DE)

(73) Assignee: Martin GmbH fuer Umwelt-und Energietechnik, Munich (DE)

( * ) Notice: Subject to any disclaimer, the term of this patent is extended or adjusted under 35 U.S.C. 154(b) by 703 days.

(21) Appl. No.: 15/076,855

(22) Filed: Mar. 22, 2016

(65) Prior Publication Data

US 2016/0290630 A1 Oct. 6, 2016

(30) Foreign Application Priority Data

Mar. 30, 2015 (DE) ..... 10 2015 003 995

(51) Int. Cl.
*F23D 14/00* (2006.01)
*F23B 30/00* (2006.01)
(Continued)

(52) U.S. Cl.
CPC ..... *F23B 7/007* (2013.01); *F23B 1/18* (2013.01); *F23G 5/0276* (2013.01); *F23G 5/165* (2013.01);
(Continued)

(58) Field of Classification Search
USPC ..... 431/5
See application file for complete search history.

(56) References Cited

U.S. PATENT DOCUMENTS 4,273,073 A * 6/1981 Robinson ..... B01J 8/36 110/245
4,279,208 A * 7/1981 Guillaume ..... F23G 5/46 110/188
(Continued)

FOREIGN PATENT DOCUMENTS

CA 2 121 295 C 2/2000
DE 196 13 777 A1 10/1997
(Continued)

OTHER PUBLICATIONS

German Office Action dated Feb. 15, 2016 in German Application No. 10 2015 003 995.4 with English translation of the relevant parts.
(Continued)

*Primary Examiner* — Vivek K Shirsat
(74) *Attorney, Agent, or Firm* — Collard & Roe, P.C.

(57) ABSTRACT

In a method for the combustion management in firing installations, in which a primary combustion gas quantity is conveyed through the fuel into a primary combustion area, part of the waste gas flow is extracted in the rear grate area and returned to the combustion process in the form of internal recirculation gas. In this case, no secondary combustion air is supplied between the grate and the supply of the internal recirculation gas. A firing installation for carrying out this method features nozzles above the firing grate such that no air supply is arranged between the firing grate and the nozzles.

14 Claims, 7 Drawing Sheets

(51) Int. Cl.

| | |
|---|---|
| ***F23L 7/00*** | (2006.01) |
| ***F23G 5/16*** | (2006.01) |
| ***F23G 5/027*** | (2006.01) |
| ***F23L 1/02*** | (2006.01) |

(52) U.S. Cl.
CPC ..... *F23L 1/02* (2013.01); *F23L 7/005* (2013.01); *F23G 2202/106* (2013.01); *F23G 2900/00001* (2013.01)

(56) References Cited

U.S. PATENT DOCUMENTS

| | | | | |
|---|---|---|---|---|
| 4,280,417 | A * | 7/1981 | Alexandersson | F23B 5/04 110/247 |
| 4,408,566 | A * | 10/1983 | Northcote | F23C 10/00 110/216 |
| 4,510,873 | A * | 4/1985 | Shigaki | F23G 5/002 110/188 |
| 5,127,345 | A * | 7/1992 | Ishikawa | F23G 5/14 110/245 |
| 5,205,227 | A | 4/1993 | Khinkis et al. | |
| 5,741,130 | A * | 4/1998 | Hagstrom | F23J 3/00 110/212 |
| 6,138,587 | A | 10/2000 | Christmann et al. | |
| 6,336,415 | B1 | 1/2002 | Rüegg et al. | |
| 7,832,342 | B2 | 11/2010 | Martin et al. | |
| 7,975,628 | B2 * | 7/2011 | Martin | F23B 80/02 110/346 |
| 8,501,131 | B2 * | 8/2013 | Moyeda | B01D 53/56 423/235 |
| 9,134,022 | B2 | 9/2015 | Hunsinger | |
| 2002/0159929 | A1 * | 10/2002 | Kaneko | C07C 29/152 422/140 |
| 2008/0063992 | A1 | 3/2008 | Martin et al. | |
| 2009/0293787 | A1 | 12/2009 | Martin et al. | |
| 2009/0301364 | A1 * | 12/2009 | Hunsinger | F23C 9/006 110/346 |

FOREIGN PATENT DOCUMENTS

| | | | | |
|---|---|---|---|---|
| DE | 19847857 | A1 * | 4/2000 | F23J 1/02 |
| DE | 10 2008 054 038 | B3 | 4/2010 | |
| EA | 0 621 448 | A1 | 10/1994 | |
| EP | 0 741 267 | A1 | 11/1996 | |
| EP | 1 698 827 | A2 | 9/2006 | |
| EP | 1 726 876 | A1 | 11/2006 | |
| EP | 1 901 003 | A1 | 3/2008 | |
| JP | S59 44513 | A | 3/1984 | |
| JP | 2001-263631 | A | 9/2001 | |
| JP | 2002-349829 | A | 12/2002 | |
| JP | 2006-275502 | A | 10/2006 | |
| RU | 2422723 | C2 | 6/2011 | |
| RU | 159987 | U1 | 2/2016 | |
| SU | 1755005 | A1 | 8/1992 | |
| WO | 99/58902 | A1 | 11/1999 | |
| WO | 2008/031410 | A1 | 3/2008 | |

OTHER PUBLICATIONS

European Search Report in EP 16000114.5-1605, dated Aug. 11, 2016, with English translation of relevant parts.
Office Action in Russian Patent Application No. 2016111620106 (018307) dated Jul. 4, 2019.

* cited by examiner

PRIOR ART

METHOD FOR THE COMBUSTION MANAGEMENT IN FIRING INSTALLATIONS AND FIRING INSTALLATION

CROSS REFERENCE TO RELATED APPLICATIONS

Applicant claims priority under 35 U.S.C. § 119 of German Application No. 10 2015 003 995.4 filed Mar. 30 2015, the disclosure of which is incorporated by reference.

BACKGROUND OF THE INVENTION

1. Field of the Invention

The invention pertains to a method for the combustion management in firing installations, in which a primary combustion gas quantity is conveyed through the fuel into a primary combustion area, wherein part of the waste gas flow is extracted in the rear grate area and returned to the combustion process in the form of internal recirculation gas.

The invention furthermore pertains to a firing installation, particularly for carrying out such a method, with a firing grate and a device that is arranged underneath the firing grate and serves for supplying primary combustion gas through the firing grate, wherein at least one suction pipe for waste gas is provided in the combustion chamber above the firing grate, and wherein the suction side of a fan is connected to the suction pipe and the pressure side of said fan is connected to nozzles via a conduit.

2. Description of the Related Art

A corresponding method and a corresponding firing installation are known from EP 1 901 003 A1. In this case, recirculation gas is used in order to reduce the volume of the waste gas flow and the polluting emissions.

SUMMARY OF THE INVENTION

The present invention is based on the objective of optimizing a method of this type in such a way that a particularly sound burn-out of solid fuels and a minimal nitrogen oxide formation are achieved.

With respect to the process technology, this objective is attained with the characteristics of the method according to one aspect of the invention. With respect to the system technology, the above-defined objective is attained with a firing installation with the characteristics according to another aspect of the invention.

The inventive method makes it possible to achieve an optimal burn-out of the waste gases with low nitrogen oxide formation, wherein a stable operation can be realized with a minimal waste gas volume at low excess air coefficients of about $\lambda=1.1$ to $\lambda=1.5$.

According to an enhanced method, it is proposed that no secondary combustion gas is supplied in a first waste gas flue.

With respect to the process technology, it is advantageous if stoichiometric to highly substoichiometric reaction conditions with $\lambda=1$ to $\lambda=0.5$ are adjusted in the primary combustion area, and if the internal recirculation gas is supplied in a burn-out area that lies downstream of the primary combustion area referred to the flow direction.

In this case, it is attempted to realize a dwell time of the waste gases of at least 2 seconds at a temperature in excess of 850° C. after the last supply of the internal recirculation gas.

An improved burn-out can be achieved by supplying a turbulence gas downstream of the primary combustion area referred to the flow direction in order to generate turbulence. This turbulence gas preferably consists of steam or inert gas.

It is furthermore proposed to supply an external recirculation gas downstream of the turbulence gas supply referred to the flow direction, wherein said recirculation gas has passed through a steam generator and, if applicable, a waste gas cleaning system.

In this case, internal recirculation gas may be supplied upstream of the turbulence gas supply.

In order to cool the internal recirculation gas and to also lower the oxygen content, it is proposed to admix external recirculation gas, which has passed through a steam generator and, if applicable, a waste gas cleaning system, to the internal recirculation gas. This also positively affects the control of the gas burn-out.

In order to influence the air ratio $\lambda$ in the primary combustion or the gasification, it is proposed to admix air to the internal recirculation gas. This also makes it possible to cool the internal recirculation gas.

The primary combustion can be substoichiometrically managed over a broad range such that air ratios $\lambda$ far below 1, namely as low as $\lambda=0.5$, can be achieved. As a result, syngas heating values up to 4000 kJ/Nm$^3$ can be measured in the gasification area of the combustion chamber such that a gasification process is carried out. In practical applications, a syngas heating value in excess of 2000 kJ/Nm$^3$, preferably in excess of 3000 kj/Nm$^3$, is adjusted in the primary combustion area upstream of the internal recirculation gas supply referred to the flow direction.

According to a special process management, it is proposed that the fuel gasifies on a gasification grate, that the cinder burn-out is ensured in the downstream burn-out grate, and that the gas burn-out is achieved in a burn-out chamber by supplying the internal recirculation gas to the waste gas flow at this location in order to burn out the gases and to achieve excess air coefficients of $\lambda=1.1$ to $\lambda=1.5$. The combustion management therefore can be controlled in such a way that the primary fuel conversion on the grate takes place under substoichiometric conditions, i.e. the fuel gasifies and the combustion does not take place until the internal recirculation gas is once again added.

Due to the defined addition of primary air and the extraction of internal recirculation gas, it is possible to gasify the fuel on the gasification grate, to control the cinder burn-out in the downstream burn-out grate and to control the gas burn-out in a burn-out chamber in a compact hybrid process. In this case, the gasification grate and the burn-out grate may consist of downstream grates or also be realized in the form of a grate. Downstream air zones on a single and, if applicable, longer grate may be assigned to the gasification grate and the burn-out grate. These air zones may be realized in the form of areas or chambers. The post-combustion gas zone or post-combustion chamber corresponds to the segment of the process, in which the internal recirculation gas is supplied to the waste gas flow in order to burn out the gases and to achieve excess air coefficients of $\lambda=1.1$ to $\lambda=1.5$.

In order to carry out the inventive method, it is proposed to arrange the nozzles downstream of the firing grate referred to the flow direction in the form of first gas supply nozzles.

It is advantageous if the design of the gas flue and the arrangement of the nozzles are realized in such a way that the waste gases reach a dwell time of at least 2 seconds at a temperature in excess of 850° C. after the last supply of the internal recirculation gas.

It is furthermore proposed to arrange turbulence nozzles with an inert gas connection or a steam connection between the firing grate and the nozzles.

Nozzles for waste gases of an external waste gas circulation may be arranged between the firing grate and the nozzles.

Other control options are realized if the suction pipe features an inlet for admixing ambient air.

According to a simple constructive design, it is proposed that the gasification grate and the burn-out grate represent serially arranged air zones on a single grate.

BRIEF DESCRIPTION OF THE DRAWINGS

The invention is described in greater detail below with reference to the drawings. In the drawings.

DETAILED DESCRIPTION OF THE PREFERRED EMBODIMENTS

Figure 1:
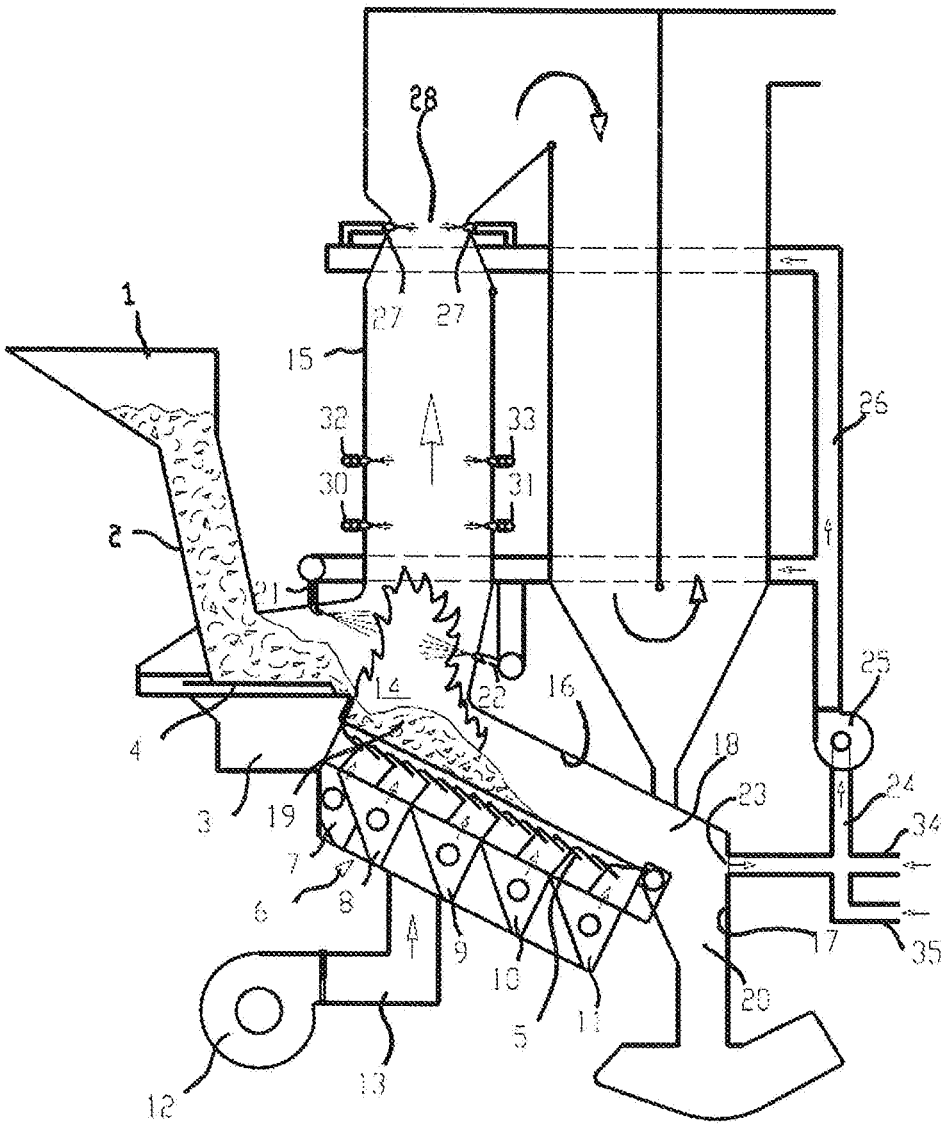
FIG. 1 shows a schematic longitudinal section through a firing installation, FIG. 2 schematically shows an air conduction according to EP 1 901 003 A1, FIG. 3 schematically shows an inventive air conduction without secondary air, FIG. 4 schematically shows the air conduction illustrated in FIG. 3 with additional nozzles for introducing steam or inert gas, FIG. 5 schematically shows an air conduction according to FIG. 4 with an additional supply of external waste gas, FIG. 6 schematically shows an air conduction with an additional supply of internal recirculation gas underneath the steam injection, FIG. 7 schematically shows a combustion management with an external gas recirculation in the form of a gas mixture of internal and external gas recirculation, FIG. 8 schematically shows a process management according to FIG. 7, in which ambient air is admixed to the internal gas recirculation.

The firing installation illustrated in FIG. 1 features a feeding hopper 1 with a downstream feeding chute 2 for delivering the fuel onto an infeed table 3, on which charging pistons 4 are provided in a reciprocating fashion in order to deliver the fuel arriving from the feeding chute 2 onto a firing grate 5, on which the combustion of the fuel takes place, wherein it is irrelevant whether the grate consists of an inclined or horizontal grate regardless of its operating principle.

A device for supplying primary combustion gas, which is altogether identified by the reference symbol 6, is arranged underneath the firing grate 5 and may comprise several chambers 7 to 11, to which primary combustion gas can be supplied by means of a fan 12 via a conduit 13. Due to the arrangement of the chambers 7 to 11, the firing grate is divided into several underblast zones such that the primary combustion gas can be adjusted differently on the firing grate in accordance with the respective requirements.

A firing chamber 14 is located above the firing grate 5, wherein the front segment of said firing chamber transforms into a waste gas flue, to which not-shown downstream units such as, for example, a waste heat recovery boiler and a waste gas cleaning system are connected.

In its rear area, the firing chamber 14 is defined by a ceiling 16, a rear wall 17 and sidewalls 18. Gasification of the fuel identified by the reference symbol 19 takes place on the front segment of the firing rate 5, above which the waste gas flue 15 is located. Most of the primary combustion gas is supplied through the chambers 7, 8 and 9 in this area.

Only fuel that has been largely burnt out, i.e. cinder, is located on the rear segment of the firing grate 5 and primary combustion gas essentially is in this area only supplied via the chambers 10 and 11 in order to cool and to realize the residual burn-out of this cinder.

The burnt-out fractions of the fuel then drop into a cinder discharge 20 at the end of the firing grate 5. The nozzles 21 and 22 are provided in the lower area of the waste gas flue 15 and supply internal recirculation gas from the rear area of the firing chamber 14 to the ascending waste gas in order to thoroughly mix the waste gas flow and to cause a post-combustion of the combustible fractions in the waste gas.

For this purpose, waste gas referred to as internal recirculation gas is extracted from the rear segment of the combustion chamber, which is defined by the ceiling 16, the rear wall 17 and the sidewalls 18. In the exemplary embodiment shown, a suction opening 23 is provided in the rear wall 17. This suction opening 23 is connected to the suction side of a fan 25 such that waste gas can be extracted. The pressure side of the fan is connected to a conduit 26 that supplies the extracted waste gas quantity to nozzles 27 in the upper area of the waste gas flue 15, namely the burn-out area 28. Part of the recirculation gas is conveyed onward from this location to the nozzles 21 and 22.

The waste gas flue 15 is significantly constricted in the burn-out area 28 or above this burn-out area in order to intensify the turbulence and the mixing effect of the waste gas flow, wherein the nozzles 27 are located in this constricted area. However, it would also be possible to provide baffles or elements 29 that interfere with the gas flow and thereby generate turbulence.

Nozzles 30 and 31 are provided on one or more levels in the waste gas flue 15 in order to supply steam and/or inert gas to the waste gas on one or more levels. In addition, nozzles 32 and 33 are provided in order to supply external recirculation gas to the waste gas on one or more levels of the waste gas flue 15. This external recirculation waste gas, which has already passed through a steam generator and, if applicable, a (not-shown) waste gas cleaning system, not only can be supplied to the nozzles 32 and 33, but also to the internal recirculation waste gas, preferably upstream of the fan 25, via the conduit 34. In addition, ambient air can be admixed to the internal recirculation gas via the conduit 35.

Based on the known method for supplying combustion gas according to EP 1 901 003 A1, which is illustrated in FIG. 2, FIGS. 3-8 show different variations of the inventive method, in which the reference symbol 51 respectively identifies the primary air, the reference symbol 52 identifies the internal gas recirculation, the reference symbol 53 identifies the waste gas, the reference symbol 54 identifies the secondary air, the reference symbol 55 identifies the steam or inert gas, the reference symbol 56 identifies external waste gas and the reference symbol 57 identifies ambient air.

Figure 2:
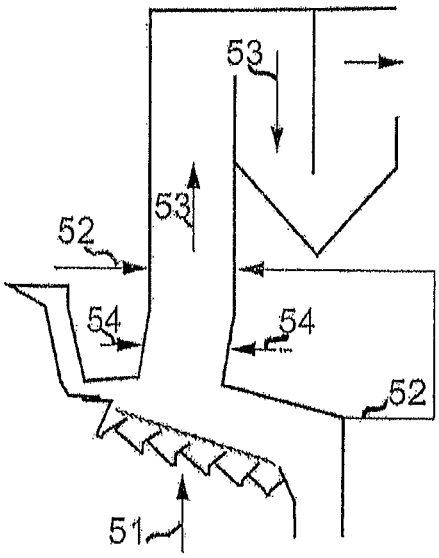
Figure 3:
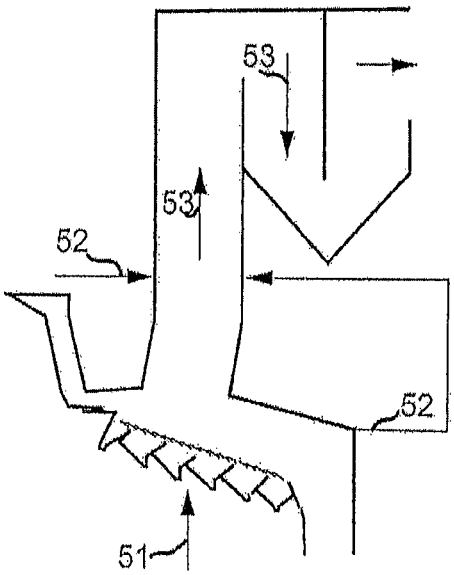
Figure 4:
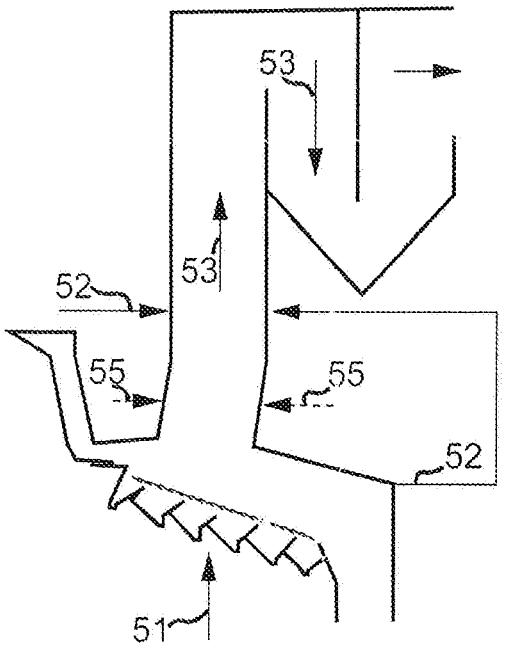
Figure 5:
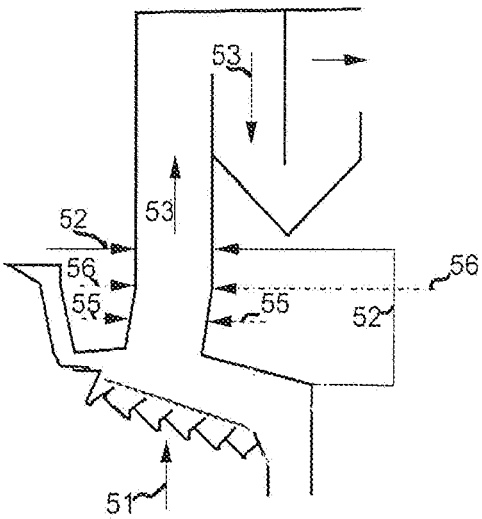
Figure 6:
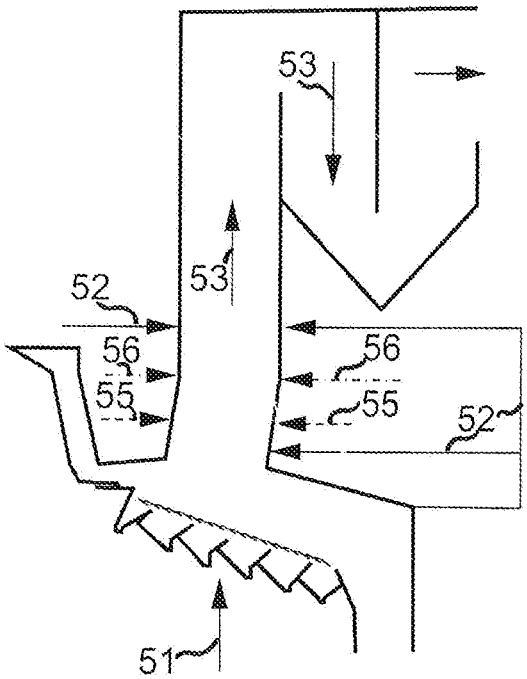
Figure 7:
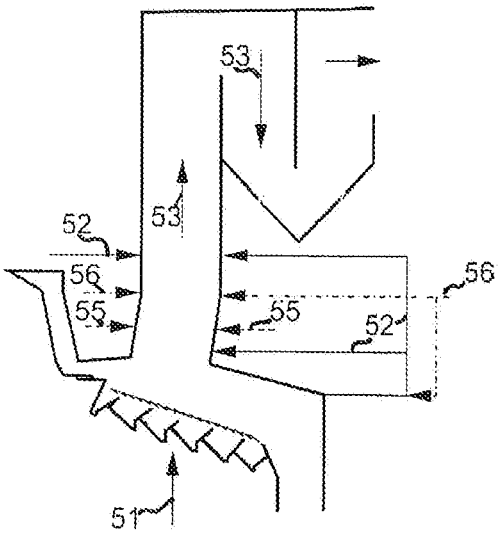

FIG. 3 shows that it is possible to completely forgo the secondary air illustrated in FIG. 2. In FIG. 4, steam or inert gas 55 is added underneath the recirculation gas 52. FIG. 5 shows the external waste gas circulation 56 and FIG. 6 shows an additional supply of internal recirculation gas 52 underneath the steam injection 55. In the design according to FIG. 7, a gas mixture of internal gas recirculation 52 and external gas recirculation 56 is supplied to the waste gas as internal recirculation gas 52.

Figure 8:
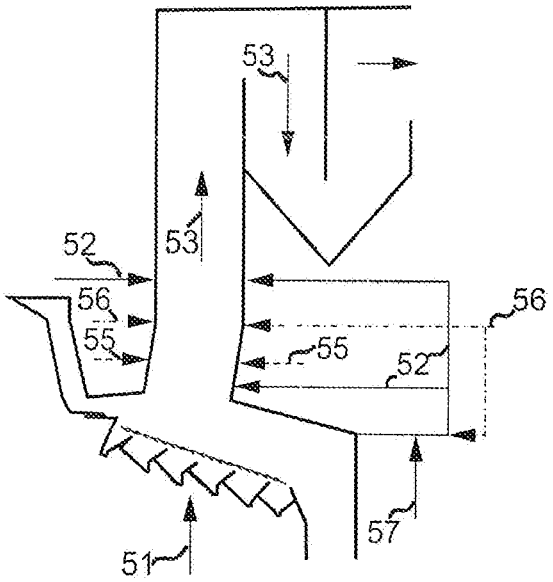

FIG. 8 shows the admixing of ambient air 57 to the internal gas recirculation 52.

Figure 9:
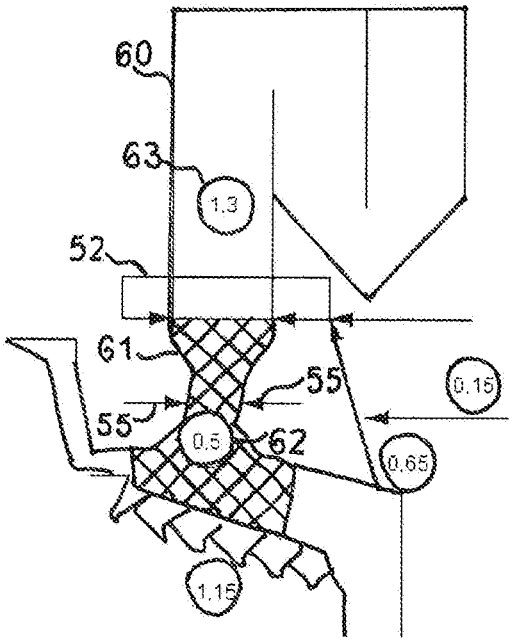
FIG. 9 shows an exemplary indication of air ratios in different areas of the schematically illustrated installation, FIG. 10 schematically shows the gasification and burn-out sequence, FIG. 11 schematically shows the gasification and combustion of the solid fuel and the burn-out of the waste gases, FIG. 12 schematically shows a process sequence with internal recirculation, gasification, combustion and burn-out.

FIG. 9 shows that a constriction 61 may be provided in the waste gas flue 60 underneath the addition of the recirculation gas 52, wherein steam or inert gas 55 can be injected in the area of this constriction. In this case, for example, lambda values of 1.15 can be adjusted above the firing grate, lambda values of 0.5 can be adjusted in the area of the constriction and lambda values of 1.3 can be adjusted above the supply of the gas of the internal recirculation 52, wherein gases with a lambda value of 0.65 can be extracted in the rear area of the grate and added with a lambda value of 0.15 during the addition of air. The area underneath the addition of the internal recirculation gas 52 therefore is substoichiometric and forms the gasification area 62 whereas the area above the addition of the internal recirculation gas is hyperstoichiometric and serves as burn-out area 63.

Figure 10:
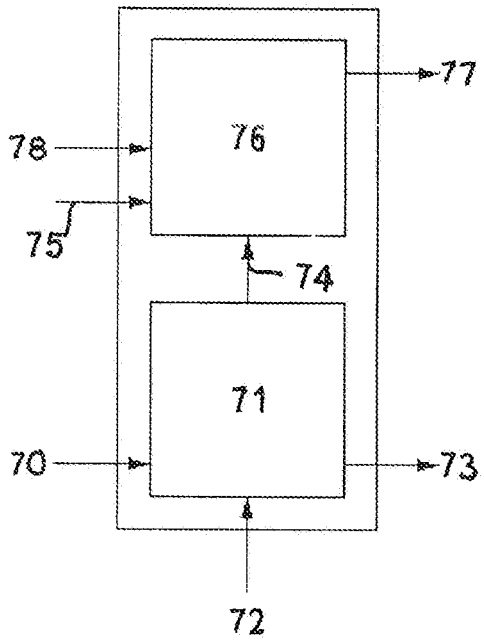
Figure 11:
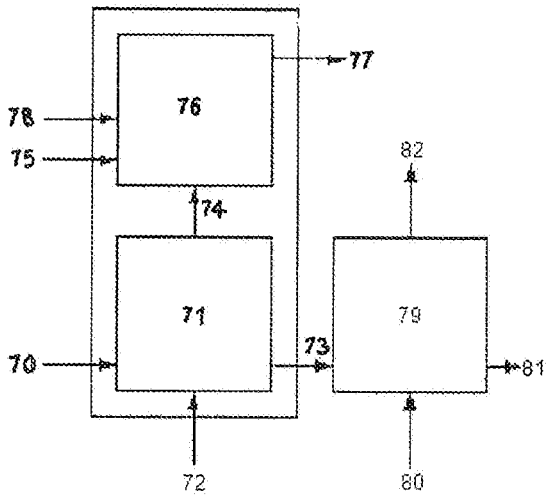
Figure 12:
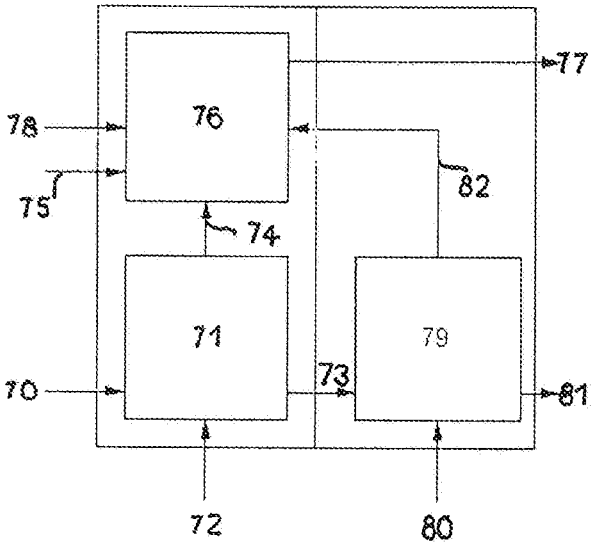

Gasification process flowcharts are illustrated in FIGS. 10-12. Garbage 70 is respectively supplied in a gasification area 71, in which the garbage gasifies into cinder 73 together with primary air 72 at a lambda value far below 1.

A syngas 74 with a heating value up to 4 $MJ/m^3$ is created during the gasification and burnt out into waste gas 77 in a burn-out area 76 with a lambda value of 1.1 to 1.5 after the addition of external recirculation gas 75. In this case, the addition of air 78 should be completely eliminated, if possible.

In case the cinder 73 is not completely burnt out during the gasification 71, a combustion area 79 for the cinder is arranged directly downstream, wherein the cinder combusts into a well burnt-out cinder 81 in said combustion area together with primary air 80 at a lambda value above 1. This combustion area produces a waste gas 82 with a lambda value >1, which is supplied to the burn-of area 76 in the form of internal recirculation gas.

Figure 13:
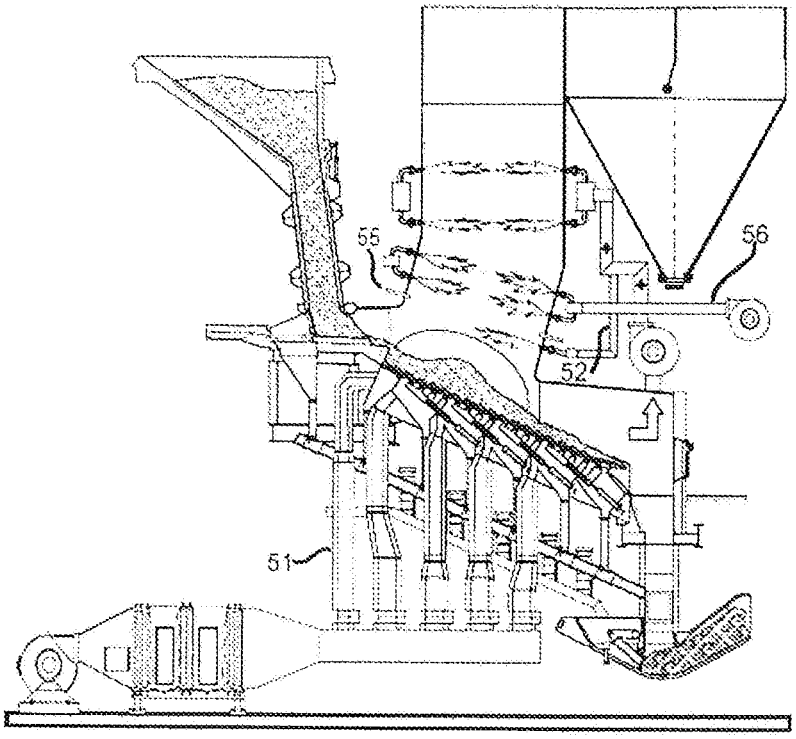
FIG. 13 shows a longitudinal section through a firing installation with a combustion gas conduction according to FIG. 6.

FIG. 13 shows a firing installation with a combustion gas conduction according to the design illustrated in FIG. 6. This firing installation is designed similar to the firing installation illustrated in FIG. 1 and suitable for the process managements schematically illustrated in FIGS. 2 to 12 just as the firing installation illustrated in FIG. 1. This figure shows an additional supply of internal recirculation gas 52 underneath the schematically indicated injection 55 of steam or inert gas. An injection of external recirculation gas 56 is provided above the steam or inert gas injection 55.

Although only a few embodiments of the present invention have been shown and described, it is to be understood that many changes and modifications may be made thereunto without departing from the spirit and scope of the invention.

What is claimed is:

1. A method for managing combustion in a firing installation, the method comprising the steps of:

conveying a quantity of primary combustion gas through a fuel into a primary combustion area, extracting a part of a waste gas flow in a rear grate area, returning the part of the waste gas flow to the combustion process as a supply of an internal recirculation gas, and adjusting stoichiometric to highly substoichiometric reaction conditions with $\lambda=1$ to $\lambda=0.5$ in the primary combustion area, and wherein the internal recirculation gas is supplied in a burn-out area that lies downstream of the primary combustion area with reference to a flow direction, wherein in a first waste gas flue, no secondary combustion air consisting of at least one of ambient air, an external recirculation gas and a mixture of ambient air and the external recirculation gas is supplied between a firing grate and the supply of the internal recirculation gas, and wherein the firing installation comprises nozzles arranged above the firing grate in such a way that both between the firing grate and the nozzles and after a last addition of the internal recirculation gas, no air supply is arranged.

2. A method for managing combustion in a firing installation, the method comprising the steps of:

conveying a quantity of primary combustion gas through a fuel into a primary combustion area, extracting a part of a waste gas flow in a rear grate area, and returning the part of the waste gas flow to the combustion process as a supply of an internal recirculation gas, supplying a turbulence gas downstream of the primary combustion area with reference to a flow direction in order to generate a turbulence, supplying the internal recirculation gas upstream of the supply of turbulence gas with reference to the flow direction, and supplying an external recirculation gas downstream of the supply of turbulence gas with reference to the flow direction, wherein said external recirculation gas has passed through at least one of a steam generator and a waste gas cleaning system, wherein in a first waste gas flue, no secondary combustion air consisting of at least one of ambient air, an external recirculation gas and a mixture of ambient air and the external recirculation gas is supplied between a firing grate and the supply of the internal recirculation gas, and wherein the firing installation comprises nozzles arranged above the firing grate in such a way that both between the firing grate and the nozzles and after a last addition of the internal recirculation gas, no air supply is arranged.

3. The method according to claim 1, further comprising the step of admixing air with the internal recirculation gas.

4. A firing installation, for carrying out a method comprising the steps of:

conveying a quantity of primary combustion gas through a fuel into a primary combustion area, extracting a part of a waste gas flow in a rear grate area, and returning the part of the waste gas flow to the combustion process as a supply of an internal recirculation gas, wherein in a first waste gas flue, no secondary combustion air consisting of at least one of ambient air, an external recirculation gas and a mixture of ambient air and the external recirculation gas is supplied between a firing grate and the supply of the internal recirculation gas, the firing installation comprising: the firing grate and a device arranged underneath the firing grate and serving to supply the primary combustion air through the firing grate, wherein at least one suction pipe for waste gas is provided in the combustion chamber above the firing grate, and wherein a suction side of a fan is connected to the suction pipe and a pressure side of said fan is connected to nozzles via a conduit, in order to extract a part of a waste gas flow in a rear grate area and return the part of the waste gas flow to the combustion process as a supply of an internal recirculation gas, wherein the nozzles are arranged above the firing grate in such a way that both between the firing grate and the nozzles and after a last addition of the internal recirculation gas, no air supply is arranged.

5. The firing installation according to claim 4, wherein the nozzles are arranged downstream of the firing grate with reference to a flow direction and the nozzles comprise first gas supply nozzles.

6. The firing installation according to claim 4, wherein a design of a waste gas flue and an arrangement of the nozzles are configured in such a way that the waste gases reach a dwell time of at least 2 seconds at a temperature in excess of 850° C. after a last supply of the internal recirculation gas.

7. The firing installation according to claim 4, wherein turbulence nozzles with an inert gas connection or a steam connection are arranged between the firing grate and the nozzles.

8. The firing installation according to claim 4, wherein waste gas nozzles for waste gases of an external waste gas recirculation are arranged between the firing grate and the nozzles.

9. The firing installation according to claim 4, wherein the suction pipe features an inlet for admixing ambient air.

10. The firing installation according to claim 4, further comprising a gasification grate and a burn-out grate configured as serially arranged air zones on the firing grate.

11. The method according to claim 2, wherein the turbulence gas comprises steam or inert gas.

12. A method for managing combustion in a firing installation, the method comprising the steps of:

conveying a quantity of primary combustion gas through a fuel into a primary combustion area, extracting a part of a waste gas flow in a rear grate area, returning the part of the waste gas flow to the combustion process as a supply of an internal recirculation gas, admixing an external recirculation gas, which has passed through at least one of a steam generator and a waste gas cleaning system, with the internal recirculation gas wherein in a first waste gas flue, no secondary combustion air consisting of at least one of ambient air, the external recirculation gas and a mixture of ambient air and the external recirculation gas is supplied between a firing grate and the supply of the internal recirculation gas, and wherein the firing installation comprises nozzles arranged above the firing grate in such a way that both between the firing grate and the nozzles and after a last addition of the internal recirculation gas, no air supply is arranged.

13. A method for managing combustion in a firing installation, the method comprising the steps of:

conveying a quantity of primary combustion gas through a fuel into a primary combustion area, extracting a part of a waste gas flow in a rear grate area, returning the part of the waste gas flow to the combustion process as a supply of an internal recirculation gas, and adjusting a syngas heating value in excess of 2000 $kJ/Nm^3$ in the primary combustion area upstream of the addition of the internal recirculation gas with reference to a flow direction, wherein in a first waste gas flue, no secondary combustion air consisting of at least one of ambient air, an external recirculation gas and a mixture of ambient air and the external recirculation gas is supplied between a firing grate and the supply of the internal recirculation gas, and wherein the firing installation comprises nozzles arranged above the firing grate in such a way that both between the firing grate and the nozzles and after a last addition of the internal recirculation gas, no air supply is arranged.

14. A method for managing combustion in a firing installation, the method comprising the steps of:

conveying a quantity of primary combustion gas through a fuel into a primary combustion area, extracting a part of a waste gas flow in a rear grate area, returning the part of the waste gas flow to the combustion process as a supply of an internal recirculation gas, wherein in a first waste gas flue, no secondary combustion air consisting of at least one of ambient air, an external recirculation gas and a mixture of ambient air and the external recirculation gas is supplied between a firing grate and the supply of the internal recirculation gas, wherein the firing installation comprises nozzles arranged above the firing grate in such a way that both between the firing grate and the nozzles and after a last addition of the internal recirculation gas, no air supply is arranged, and wherein the fuel gasifies on a gasification grate, wherein a cinder burn-out is ensured in a downstream burn-out grate, and wherein a gas burn-out is achieved in a burn-out chamber by supplying the internal recirculation gas to the waste gas flow at this location in order to burn out the gases and to achieve excess air coefficients of lambda=1.1 to lambda=1.5.

* * * * *